United States Patent [19]

Hvezda et al.

[11] Patent Number: 4,700,998

[45] Date of Patent: Oct. 20, 1987

[54] MULTIPLE CONTACT CONNECTOR HAVING A LOW INSERTION FORCE

[75] Inventors: Jaroslav M. Hvezda, Nepean; Benne Velsher, Ottawa; Richard J. Middlehurst, Kanata, all of Canada

[73] Assignee: Northern Telecom Limited, Montreal, Canada

[21] Appl. No.: 897,946

[22] Filed: Aug. 19, 1986

[51] Int. Cl.[4] ..... H01R 13/62

[52] U.S. Cl. ..... 439/325; 439/630

[58] Field of Search ..... 339/176 MP, 75 MP

[56] References Cited

U.S. PATENT DOCUMENTS

| | | | |
|---|---|---|---|
| 4,118,094 | 10/1978 | Key | 339/75 MP |
| 4,392,704 | 7/1983 | Porter | 339/176 MP |
| 4,448,466 | 5/1984 | Porter | 339/75 MP X |

FOREIGN PATENT DOCUMENTS

| | | | |
|---|---|---|---|
| 2114 | 5/1979 | European Pat. Off. | 339/75 MP |
| 2423266 | 12/1974 | Fed. Rep. of Germany | 339/75 MP |
| 2643978 | 3/1978 | Fed. Rep. of Germany | 339/75 MP |
| 44-22981 | 9/1969 | Japan | 339/75 MP |
| WO82/01280 | 4/1982 | PCT Int'l Appl. | 339/75 MP |
| 639056 | 12/1978 | U.S.S.R. | 339/75 MP |

*Primary Examiner*—William R. Briggs

*Attorney, Agent, or Firm*—Sidney T. Jelly

[57] ABSTRACT

A plug-in form of connector having two connecting members, one inserted into the other, has pairs of opposed contacts. Each pair of contacts is connected electrically by a pivoted contact lever, which pivots about an axis normal to its length as one connecting member is inserted into the other. This increases contact normal forces from a minimum at initial insertion. A reduction in insertion force is obtained without a reduction in contact normal forces on full insertion.

15 Claims, 14 Drawing Figures

MULTIPLE CONTACT CONNECTOR HAVING A LOW INSERTION FORCE

This invention relates to a multiple contact connector having a low insertion force. In particular, the invention relates to a backplane connector as used in telecommunications systems.

In many connection arrangements, it is necessary to make a large number of connections at the same time. For backplane connections, where a circuit board is plugged into a backplane, there can be a very high "pin count", exceeding two hundred. With the usually desired "contact normal force", that is, the contact force between the two contacting members acting normal to the contact surfaces and space restrictions, very high insertion forces can occur with conventional connections, such as pins inserted into box terminals. As the desired number of contacts, known as "pin count", increases, it becomes increasingly difficult to insert a "plug-in" using pins and box terminals.

The present invention considerably reduces insertion forces while maintaining the required contact normal forces. Pivotal members are used between contact members on each connector member, such that insertion of one connector member into another connector member causes the pivotal members to pivot, creating the desired contact forces between the pivotal members and the contact members, without high insertion forces.

Broadly, a connector in accordance with the invention comprises two connector members, one member inserted into the other, providing two pairs of opposed surfaces. Contact members are provided on each surface to form pairs of contacts to be connected. A pivotal contact lever is positioned to connect each contact of a pair as the one member is inserted into the other, the contact lever pivoting about an axis transverse to its length to increase contact normal forces at the contacts.

The invention will be readily understood by the following description of various embodiments, by way of example, in conjunction with the accompanying diagrammatic drawings, in which.

Figure 1:
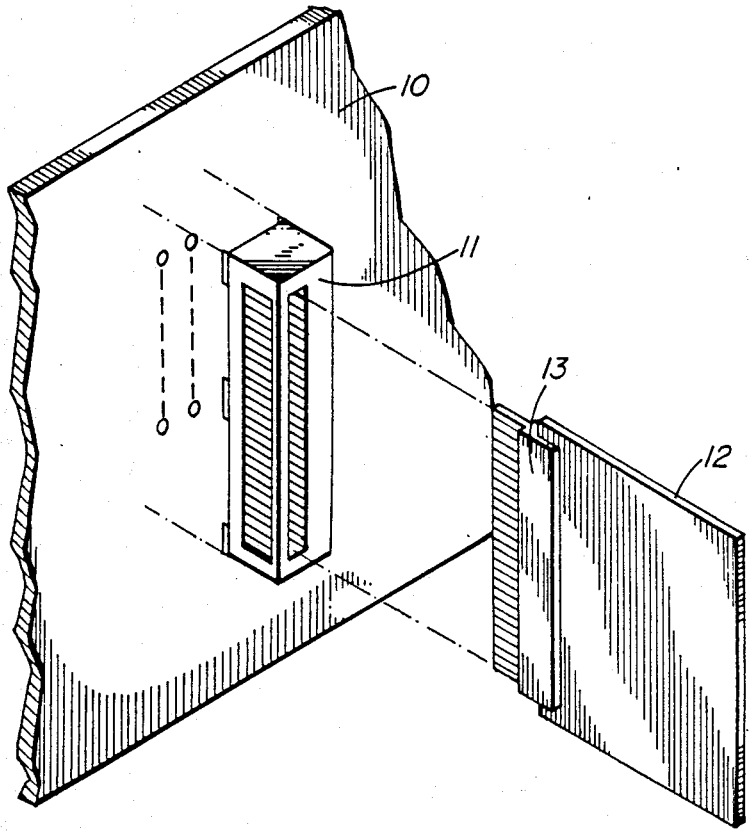
FIG. 1 is a perspective exploded view illustrating a backplane, a circuit board and the related connector members.

As illustrated in FIG. 1, in the particular example, a backplane 10 of a telecommunications system has one connector member 11 mounted thereon, and a circuit board 12 has another connector member 13 mounted on its front leading edge. In the example, connector member 11 is a female member and connector member 13 is a male member. Spaced contacts along each side of the contact member 13 are connected to spaced contacts along each side of connector member 11.

Figure 2:
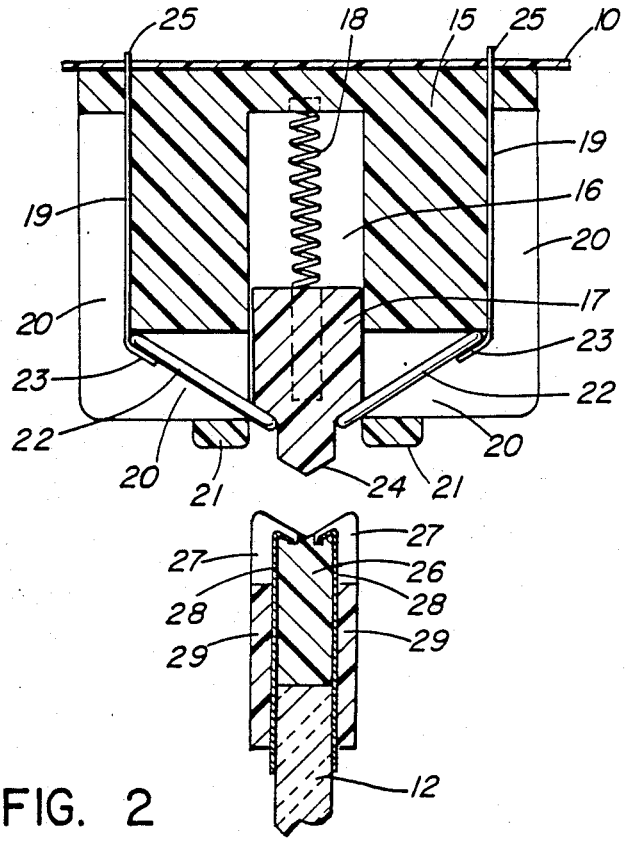
FIGS. 2 to 6 are transverse cross-sections through one connector member as mounted on a backplane and the other connector member as on the edge of a circuit board, illustrating successive stages of insertion.

FIG. 2 illustrates in cross-section a particular embodiment of the arrangement shown in FIG. 1. An elongate molded plastic connector member 15 is mounted on the backplane 10. In a longitudinally extending slot 16 is mounted a slideable member 17, spring loaded towards the front of the member 15 by a plurality of springs 18 spaced along the slot 16. Along each side of the member 15 are positioned a plurality of cantilever spring contacts 19. These are seen more clearly in FIG. 7. The contacts are positioned in grooves 20 extending down the sides of member 15 and across the front face. Two retaining members 21 extend along the front face of member 15, positioned on either side of and adjacent to the slot 16. A plurality of contact levers 22, in the form of pins, extend between the free ends 23 of the contacts 19 and a projection 24 on the slideable member 17, retained in position by the retaining members 21. The contacts 19 extend through the backplane 10 and provide connecting ends 25 for electrical connection to the backplane or to which conductors can be attached.

The circuit board connector member 26 has a plurality of grooves 27 extending from the edge, with a contact 28 in each groove. A groove 27, and contact 28, is aligned with each contact lever 22. An abutment member 29 extends along each side of member 26. The whole assembly can be molded as a unit, with the connector 26 and abutments 29 integral. The contacts 28 can also be prepositioned in the molding die and molded into the connector member 26. The contacts 28 extend down over the edge of the circuit board 12 where connections can be made to the circuit patterns on the circuit board.

Figure 3:
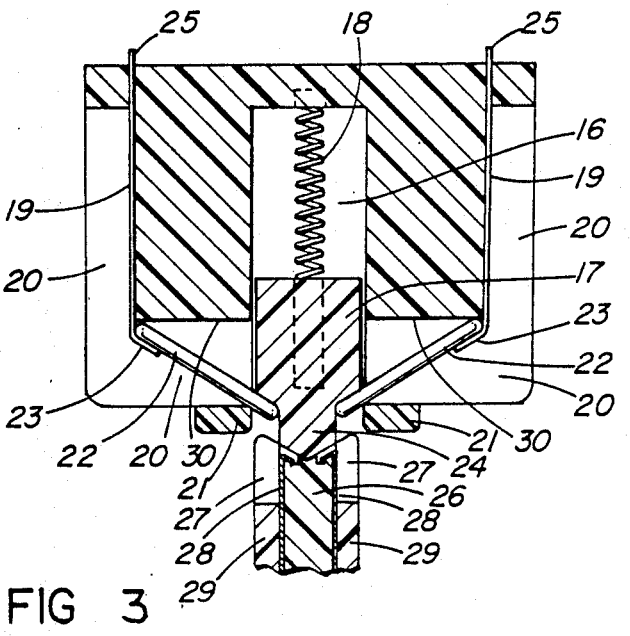
Figure 4:
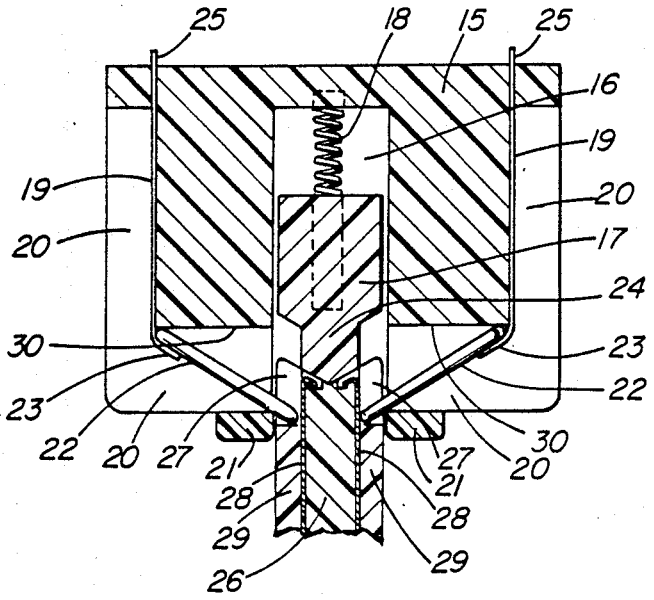
Figure 5:
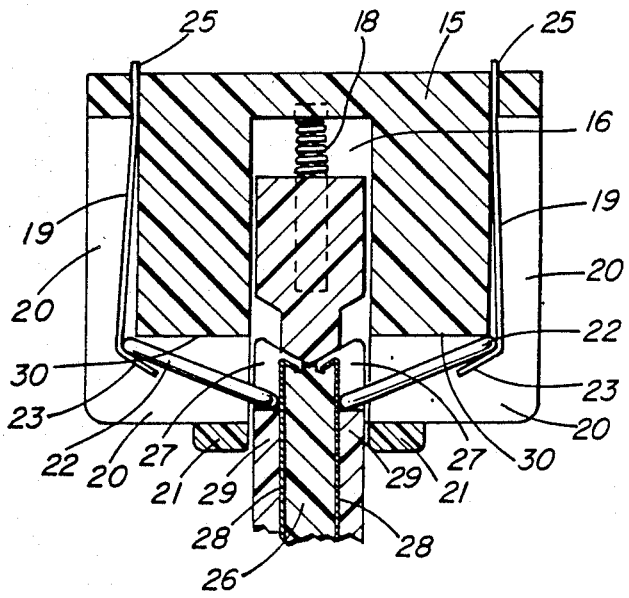
Figure 6:
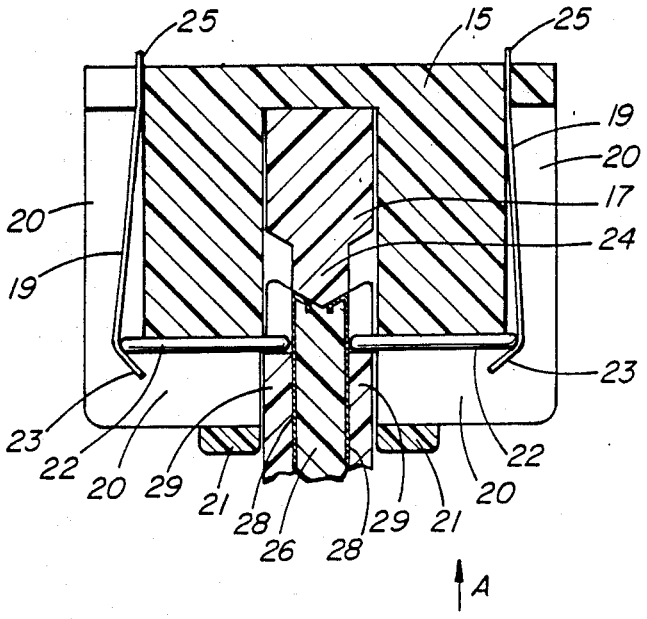

As the circuit board is moved towards the backplane, the end of the connector member 26 moves into contact with the projection 24. This is illustrated in FIG. 3. Continued movement of the circuit board pushes back the member 17 against springs 18, and the abutment members 29 move into initial contact with the inner ends of the contact levers 22. This is illustrated in FIG. 4. Further movement of the circuit board towards the backplane continues to move the member 17 rearwards and the contact levers 22 are now pushed up at their inner ends, causing them to pivot about their outer ends where the outer ends are in contact with the contacts 19. This will also cause the outer end to move outward—they cannot move upward because of the bottom surface 30 of slot 20—and the cantilever contacts 19 are pushed out at their lower ends. This is illustrated in FIG. 5. The final position is illustrated in FIG. 6, in which the connector member 26 on the circuit board 12 is fully inserted. Member 17 is at its most rearward position and the contact levers extend across between the contacts 28 and contacts 19, resting against the surface 30. At this position, the cantilever contacts 19 exert a force on the outer end of the contact lever 22 and the contact lever 22 exerts a force on the contact 28. These forces can be the desired contact normal force, but the force required to push in the circuit board connector member is relatively low. For example, a 3:1 reduction in maximum insertion force is obtained. A reverse sequence takes place as the circuit board is withdrawn from the backplane, but on withdrawal there is no force required to move the circuit board out. There is a positive force tending to push the board out and the board is latched into position once inserted.

Figure 7:
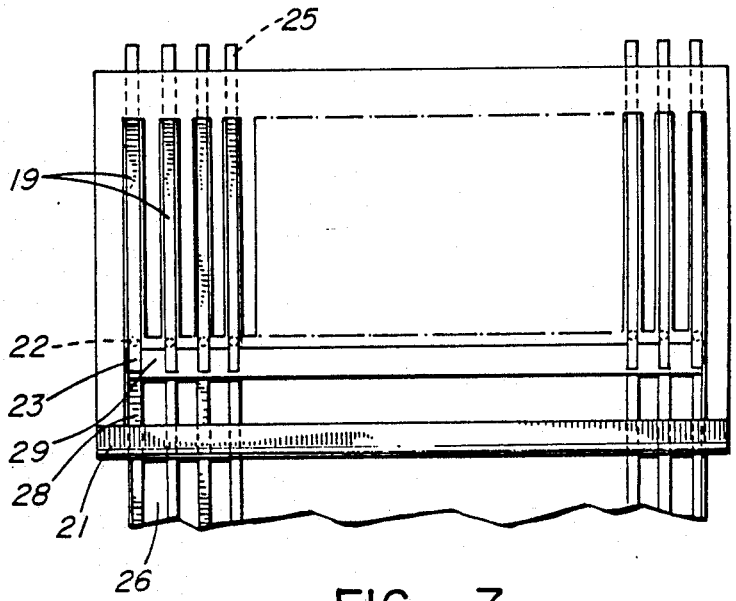
FIG. 7 is a side view on the backplane and circuit board connector members in a fully inserted condition, as in FIG. 6.
Figure 8:
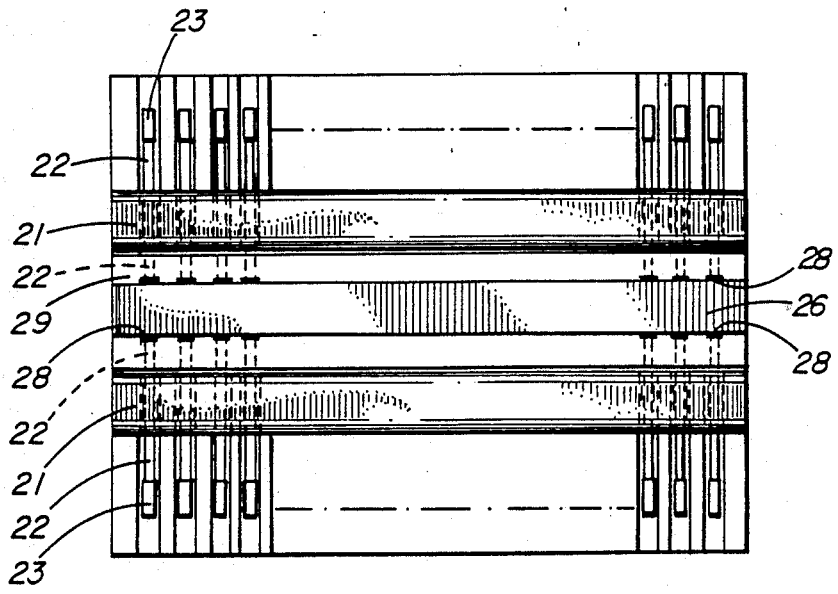
FIG. 8 is a front view of the backplane connector member in the direction of arrow A in FIG. 6.

FIGS. 7 and 8 illustrate the connector members as in FIG. 6, from the side and front respectively. The FIGS. 2 to 8 are very much larger in scale than the actual connector. Contact pitches of 0.1" pitch and 0.05" pitch for the contacts are readily obtainable.

In the embodiment illustrated in FIGS. 2 to 8, the contact levers are loose pins and the central slideable member 17 is required to retain the pins in the connector member 15, once assembled. The pins are inserted by pressing back the member 17 and then inserting the pins. Release of members 17 then traps the pins between the ends 23 of the contacts 19, projection 24 and retaining member 21.

Figure 9:
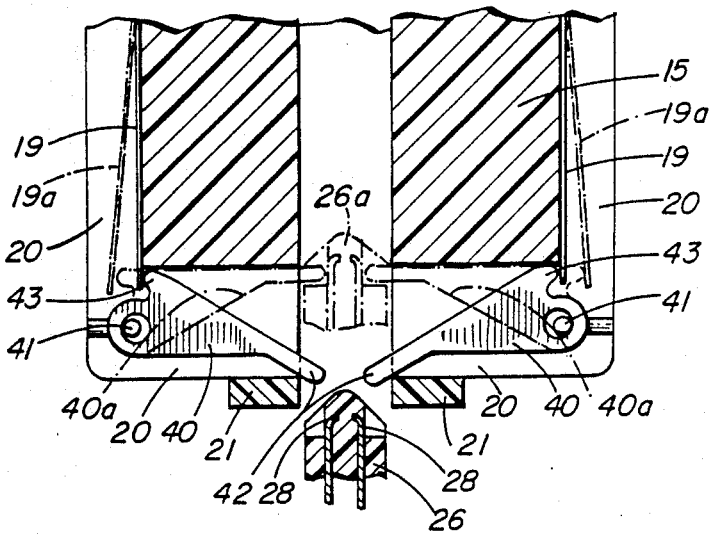
FIG. 9 is a transverse cross-section, similar to that of FIGS. 2 to 6, illustrating an alternative form of contact lever.
Figure 10:
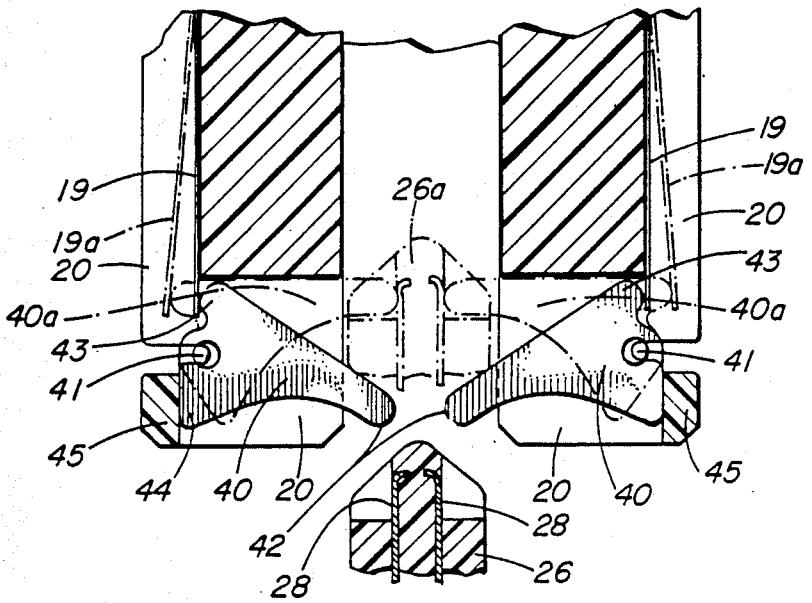
FIG. 10 is a transverse cross-section, as in FIG. 9, illustrating a modified form of the contact lever of FIG. 9.

FIGS. 9 and 10 illustrate alternative embodiments using different forms of contact levers. In FIG. 9, contact levers 40 are stamped from thin metal sheet and pivot about electrically insulating rods 41 which extend along each side of the connector member 15. To maintain the contact levers 40 against pulling or pivotting right down, the retaining members 21 are still provided. In the arrangement of FIG. 9, contacts 28 on the member 26 make contact with the inner ends 42 of the contact levers 40 on initial insertion. As the connector member 26 is inserted further, the ends 42 of the contact levers 40 are pushed up, the contact levers pivotting about the rods 41. This causes a top end 43 of each contact lever to pivot outwards. The top ends 43 bear against the contacts 19 and as the contact levers pivot, the ends 43 push the contacts out. The final positions of connector member, contact levers and contacts are illustrated by dotted outlines 26*a*, 40*a* and 19*a*, respectively.

In FIG. 10, the contact levers 40 are modified to have a downward projection 44 which bears against a rib 45 extending along the front outer corner of the connector member. This prevents the contact levers moving down too far when the circuit board connector member is not inserted. The operation of the embodiment in FIG. 10 is the same as in FIG. 9.

Figure 11:
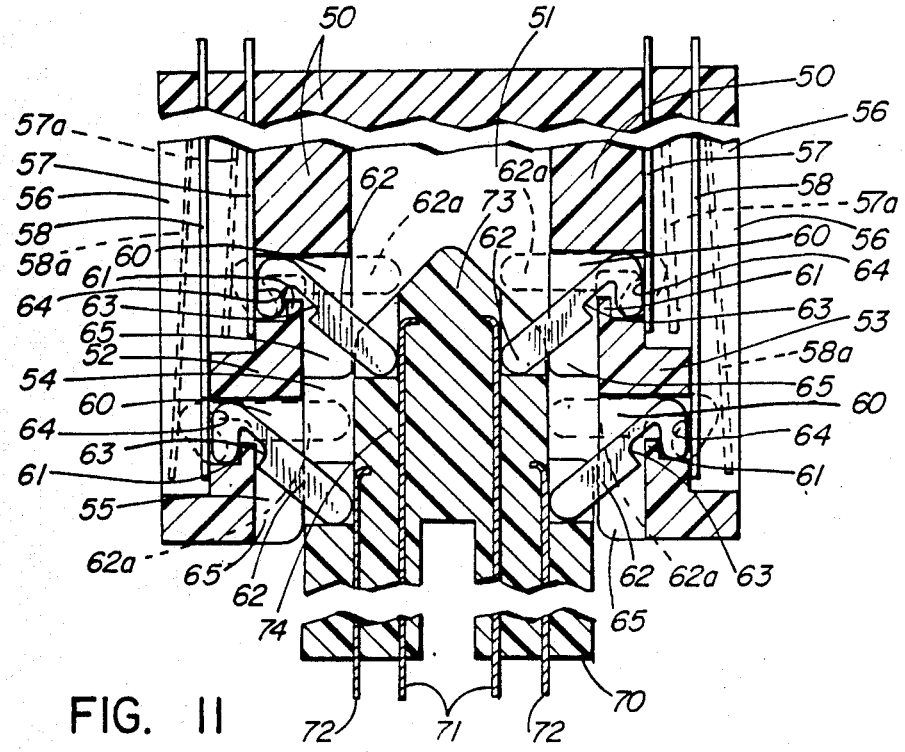
FIG. 11 is a transverse cross-section, as in FIGS. 2 to 6, illustrating two rows of contacts on each side of the connector, with yet another form of contact lever.

The embodiments so far described have a single row of contacts on each side of each connector member. At a contact pitch of 0.1", this gives twenty contacts per linear inch length of connector. With a 0.05" pitch, it is possible to obtain forty contacts per linear inch of connector. By increasing the number of rows of contacts per side, it is possible to increase contact density. FIG. 11 illustrates one embodiment in which two rows of contacts are provided on each side of the connector. In FIG. 11, the backplane connector member 50 has a central longitudinally extending slot 51, forming two walls 52 and 53. The walls are stepped on the inside surfaces to give a first widened portion or area 54 and a second widened portion or area 55. Area 54 is wider than the basic slot 51 and portion 55 is wider than portion 54. Portion 55 is at the open end of the connector member and portion 54 is rearward of but immediately adjacent to the portion 55. On the outside surface of the walls 52 and 53 are formed a plurality of slots 56 extending from the back of the member toward the front. Each slot has two portions, one deeper than the other. The deeper portion is rearmost, so that the forward end of the shallower portion of each slot forms a step. Two rows of cantilever spring contacts 57 and 58 extend in the slots 55. Contacts 57 are positioned in the deeper portions of the slots 56 while the free ends of contacts 58 overlap the shallower portions of the slots. The upper ends of the rows of contacts are held in spaced relationship in the back end of the connector member.

Four rows of transverse slots or apertures 60 are formed through the walls 52 and 53. One row is formed in each wall to interconnect the first widened portion 54 with the deeper portion of each slot 56. A second row of slots or apertures 60 is formed in each wall interconnecting the second widened portion 55 with the shallower portion of each slot 56. Each slot 60 has a rib 61 extending rearward at the edge immediately adjacent the central slot 51. In each slot 60 is positioned a hooked contact lever 62. Each lever 62 is recessed at 63 at the bend of the hook, the recesses resting over the ribs 61, the contact levers effectively pivotting on the ribs. The hooked ends of the contact levers have a flat end surface 64 and the free ends of the spring contacts 57 and 58 rest on these flat end surfaces when the circuit board connector member is not inserted. This causes the free ends of the contact levers to be inclined towards the front of connector member 50, projecting into the slot 51. To provide guidance for the contact levers 62, the free ends of the levers are positioned in slots 65 on the inner surfaces of the portions 54 and 55 of slot 51.

The circuit board connector member 70 has two sets of contacts 71 and 72, in the example molded into the connector member. Contacts 71 extend through the connector member and are exposed on either side of a projection 73. Contacts 72 extend through the connector member and are exposed on an intermediate portion 74 of the connector member. The connector member slides up into the slot 51, the intermediate portion 74 of the connector member being a fairly close sliding fit in the main portion of slot 51 and the main body of the connector member being a sliding fit in the widened portion or area 54 of the slot 51.

On initial insertion of the circuit board connector member 70, the free ends of the levers 62 make contact with the contact members 71 and 72. This is as shown in FIG. 11. Continued insertion of the circuit board connector member pivots the levers 62 on ribs 61 and the bends of the hooked ends of the contact levers 60 push out the spring contacts 57 and 58. When the connector member 70 is fully inserted, the contact levers 62 are in contact with the back surfaces of the slots 60 and the spring contact members 57 and 58 are at their outermost positions. This is illustrated by the positions of contact lever 62 and contacts 57 and 58 in dotted outline at 62*a*, 57*a* and 58*a*, respectively.

Figure 12:
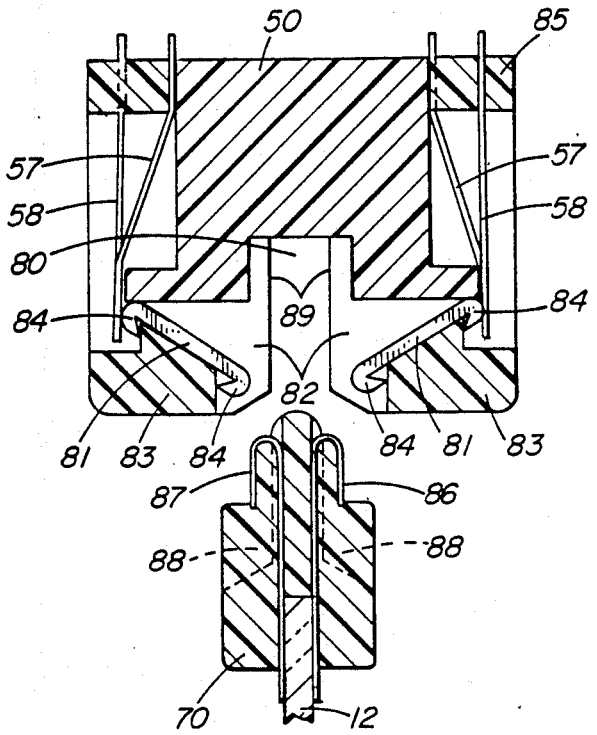
FIG. 12 is a transverse cross-section through a further form of connector.
Figure 13:
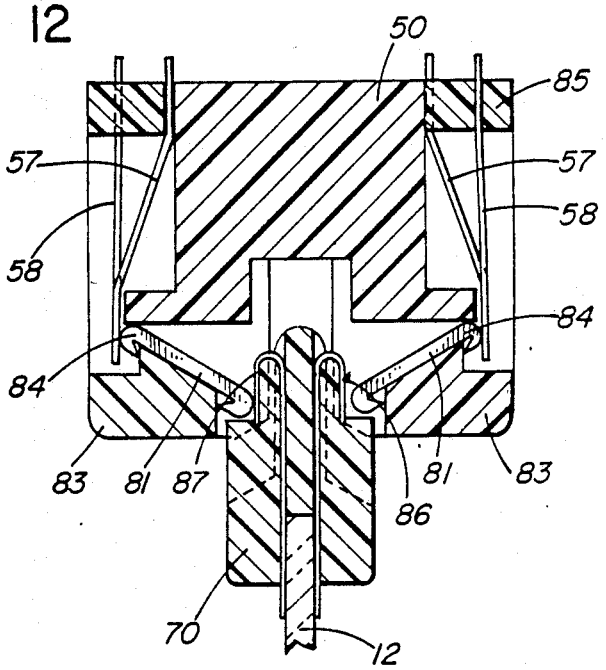
FIGS. 13 and 14 are similar cross-sections to that of FIG. 12 illustrating intermediate and final stages of connection.
Figure 14:
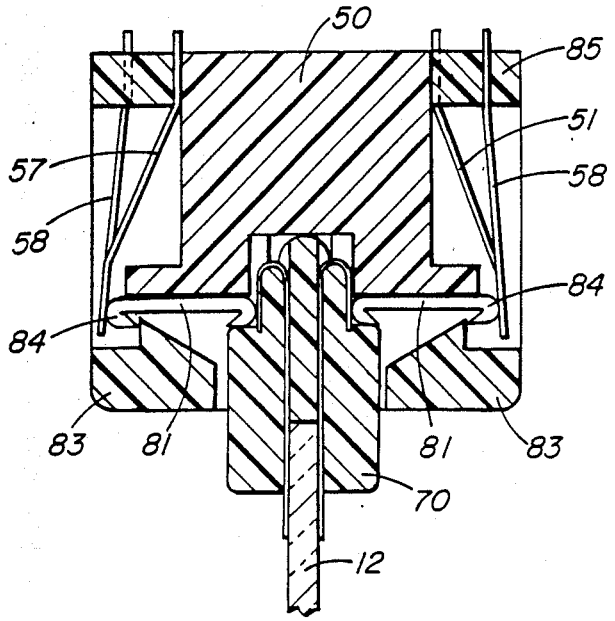

FIGS. 12, 13 and 14 illustrate a further form of connector having two rows of contacts are provided on each side of the connector. Where applicable, common reference numerals are used in FIGS. 12, 13 and 14 as in FIG. 11, for the same items.

Considering FIG. 12, the back plane member 50 has a central longitudinal recess 80. A plurality of contact levers 81 are positioned in slots 82 in the front edge of member 50, the contact levers being retained in the slots by a retaining member 83. The contact levers 81 are hook-shaped at each end at 84 and at their outer ends the hook shape extends over the top edge of the retaining member. Two sets of cantilever spring contacts 57 and 58 are provided on each side of member 50, being positioned at their upper ends in a holding member 85. The cantilever spring contacts 57 and 58 alternate along each side of member 50, with their lower ends resting on the outer ends of the contact levers 81.

The circuit board connector member 70 has two rows of contacts 86 and 87, one row on each side. The contacts 86 and 87 are positioned to make contact alternately with cantilever spring contacts 57 and 58. Slots can be formed in the connector member 70, indicated by dotted lines 88, to cooperate with webs 89 on the member 50, between slots 82.

FIG. 12 illustrates the circuit board connector member prior to insertion in connector member 50. In FIG. 13, the circuit board connector member 70 has just entered into the backplane connector member 50, with contact between the contact levers 81 and the contacts 86 and 87 just about to occur. In FIG. 14, the circuit board contact member 70 is fully inserted. The contact levers have been pivotted upward at their inner ends, in contact with contacts 86 and 87. Their outer ends deflect the cantilever spring contacts 57 and 58 outwards.

In all of the examples described, a high contact normal force, for example typically about 100–140 grams, occurs at all contact points. At the same time, because of the use of contact levers, it gives a mechanical advantage, for example in the range of 3:1 to 5:1, which gives very low insertion forces, for example about 15 kg for 360 contacts.

Starting at a zero force on initial insertion, the insertion force builds up as the circuit board connector member is pushed in, reaching a maximum value at an intermediate insertion position. The insertion force then decreases as insertion increases. At full insertion, with the maximum contact force between contacts and the contact levers, the insertion force approaches zero. The pivotting action which occurs at both ends of the contact lever, where contact is made with contacts on the backplane connector member and on the circuit board connector member, gives a sliding and wiping action with a high quality electrical contact.

Various modifications and variations can be made. Thus, as an example, the connector member 13, and the corresponding connector members of FIGS. 2 to 14, can be formed as part of the circuit board 12 or similar member. Both connector members can be made as integral members of the two structures to be connected.

The contacts 28 on the connector member 26, in FIG. 2, can readily be part of a circuit pattern on a circuit board, the contacts 28 being etched at the same time as the rest of the circuit pattern.

What is claimed is:

1. A multiple contact connector comprising: two connector members, one connector member for insertion in the other connector member; said other connector member comprising an elongate body member, and a slot extending into said body member from a front surface and extending longitudinally; said connector members forming at least two pairs of spaced surfaces; transverse slots in said front at least two pairs of spaced surfaces; transverse slots in said front surface; contacts on each of said surfaces, said contacts arranged to form pairs of opposed contacts; and a plurality of contact levers pivotally mounted in a connector member, a contact lever in each of said transverse slots, inner ends of said contact levers extending into said slot extending into said body member, each contact lever adapted to extend between and connect a pair of contacts, insertion of said one connector member causing each said contact lever to pivot about an axis transverse to its length, the ends of each contact lever moving in contact with related pair of contacts, to increase the contact normal forces at said contacts as said one connector member is inserted; and a retaining member on each side of said slot extending into said body member, and retaining said contact levers in said transverse slots when said one connector member is withdrawn.

2. A connector as claimed in claim 1, comprising one pair of surfaces on each side.

3. A connector as claimed in claim 1, said contacts in spaced parallel array on each surface.

4. A connector as claimed in claim 1, said contact levers pivotally mounted on said other connector member.

5. A connector as claimed in claim 1, said contacts on said surfaces of said other connector member comprising spring cantilever contacts, outer ends of said contact lever in contact with free ends of said spring cantilever contacts.

6. A connector as claimed in claim 1, comprising cantilever spring contacts extending on either side of said body member, free ends of said cantilever members positioned at said front surface, outer ends of said contact levers in contact with said free ends, inner ends of said contact levers extending into said slot; said one member slideable into said slot, said inner ends of said contact levers in contact with said contacts on said surfaces of said one member on insertion of said one member; continued insertion of said one member moving said inner ends rearward and pivotting said contact levers, said outer ends moving said free ends outwards.

7. A connector as claimed in claim 1, including an abutment member extending along said body member at said front surface and at each side of said body member.

8. A connector as claimed in claim 7, said contact levers formed of sheet metal, a pivot position on each contact lever at a position intermediate the ends of the contact lever, means mounting each contact lever on said other connector member at said pivot positions; an extension on each contact lever extending to contact an abutment member when said inner ends of said contact levers are in a forward position and said one connector member is withdrawn.

9. A connector as claimed in claim 1, including a slideable member positioned in said slot in said body member, the slideable member moveable in a direction normal to said front surface; means resiliently urging said slideable member towards said front surface, said slideable member holding said inner ends of said contact levers onto said abutments, when said one connector member is withdrawn.

10. A connector as claimed in claim 9, including a projection on a front end of said slideable member, said projection extending between said abutments when said slideable member is in a forward position.

11. A connector as claimed in claim 1, said contact levers each including a pivot position intermediate the ends of the contact lever, and means mounting said contact levers on said other connector member at said pivot positions.

12. A connector as claimed in claim 11, said contact levers formed of sheet metal, said pivot positions comprising a hole through each contact lever, said means mounting said contact levers comprising a pin passing through said holes.

13. A connector as claimed in claim 1, said body member having opposite side surfaces, a plurality of grooves in each side surface, said grooves extending in a direction normal to said front surface, said grooves each having an outer part and an inner part, said outer part extending towards said front surface for a greater distance than said inner part to form an abutment, a first plurality of cantilever spring contacts in said outer parts of said grooves and having free ends resting on said abutments, a second plurality of cantilever spring contacts in said inner parts of said grooves, a first plurality of apertures extending from said slot in said body member through to said inner parts of said plurality of grooves, a second plurality of apertures extending from said slot in said body member to said outer parts of said plurality of grooves, a contact lever pivotally mounted in each aperture, inner ends of the contact levers extending into said slot, outer ends of the contact levers extending into said plurality of grooves and in contact with said cantilever spring contacts in said plurality of grooves;

said one connector member slideable into said slot and having a forward extension and an intermediate portion, said intermediate portion wider than said extension, a first plurality of contacts extending on either side of said extension and a second plurality of contacts extending on either side of said intermediate portion, said first and second pluralities of contacts making contact with contact levers in contact with said second plurality of spring contacts and with said first plurality of spring contacts respectively, on insertion of said one connector member into said slot, insertion of said one connector member causing pivotting of said contact levers.

14. A connector as claimed in claim 13, including a rib at an inner edge of each aperture adjacent to said slot, with said rib on a side of an aperture closest to said front surface; a recess in each contact lever, the recesses in said contact levers resting on said ribs.

15. A connector as claimed in claim 14, said inner ends of said contact levers extending into slots on side surfaces of said slot, each said contact lever having a hook-shaped outer end, extending toward said front surface, said recess in each contact lever formed immediately adjacent to said hook-shaped outer end, the arrangement such that the inner ends of said contact levers extend in said slots in the side surfaces of said slot toward said front surface, insertion of said one connector member pivotting said contact levers, said inner ends moving inwards into said slot and rearwards away from said front surface, the contact levers pivotting on said ribs and said hooked end pivotting outwards into said grooves in said side surfaces.

* * * * *